US006368765B2

(12) United States Patent
Izu et al.

(10) Patent No.: US 6,368,765 B2
(45) Date of Patent: Apr. 9, 2002

(54) METHOD OF PRODUCING TONER FOR DEVELOPING LATENT ELECTROSTATIC IMAGES

(75) Inventors: Mitsuyoshi Izu; Nobuyasu Makino; Tomotsugu Miyamoto; Yasuaki Iwamoto; Ryoichi Ito; Kazuyuki Yazaki, all of Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/765,392

(22) Filed: Jan. 22, 2001

(30) Foreign Application Priority Data

Jan. 21, 2000 (JP) ..... 2000-012698

(51) Int. Cl.[7] ..... G03G 9/06
(52) U.S. Cl. ..... 430/137.2; 241/29
(58) Field of Search ..... 430/137.18, 137.19, 430/137.2; 241/29

(56) References Cited

U.S. PATENT DOCUMENTS 5,527,558 A * 6/1996 Daidoji et al. ..... 430/137.2
5,716,751 A * 2/1998 Bertrand et al. ..... 430/137.18
6,174,641 B1 * 1/2001 Nakamura et al. ..... 430/137.2

* cited by examiner

*Primary Examiner*—John Goodrow
(74) *Attorney, Agent, or Firm*—Oblon, Spivak, McClelland, Maier & Neustadt, P.C.

(57) ABSTRACT

A method of producing a toner for developing latent electrostatic images includes the steps of preliminarily grinding a toner composition having at least a binder resin and a coloring agent to prepare a preliminarily ground product, and finely pulverizing the preliminarily ground product using a pulverizer to produce toner particles, wherein the preliminarily ground product satisfies conditions (1) and (2):

$$D_v \geqq D_{10} \quad (1)$$

$$D_{50} < 3D_{10} \quad (2)$$

wherein $D_v$ is a weight mean diameter of the preliminarily ground product, $D_{10}$ is a weight mean diameter when the cumulative number of particles reaches 10% at measurement of a cumulative particle distribution, and $D_{50}$ is a weight mean diameter when the cumulative number of particles reaches 50% at measurement of the cumulative particle distribution.

19 Claims, No Drawings

METHOD OF PRODUCING TONER FOR DEVELOPING LATENT ELECTROSTATIC IMAGES

BACKGROUND OF THE INVENTION

1. Field of the Invention

The present invention relates to a method of producing a toner for developing latent electrostatic images. More particularly, the present invention relates to a method for producing toner particles with a minimum amount of excessively fine particles by the application of a reduced energy.

2. Discussion of Background

Image forming apparatus such as an electrophotographic copying machine, printer, and facsimile machine output a recording image in such a manner that latent electrostatic images are formed on a latent-image-bearing member and the latent electrostatic images are developed with a developer into visible images. A dry developer unit employing a powdered toner is widely used in the above-mentioned image forming apparatus.

In line with the development of a digital copying machine and a laser printer, the developer unit is required to produce high quality images. In particular, output of high quality images with a density of 300 dpi has currently become the mainstream in the field of printers. Further advance of the image density to 480 dpi and 600 dpi is expected.

Under such circumstances, severe control for obtaining small toner particle size is inevitable. However, the toner particles with small particle diameters tend to aggregate and adhere to each other, so that such toner particles cannot be easily sent to a development section from a toner replenishment section in the course of development of latent electrostatic images. The toner particles cannot be sufficiently transferred to a photoconductor from the development section, with the result that the image density decreases and defective image transfer easily occurs. Such a phenomenon becomes noticeable as the size of toner particles decreases. In other words, the particle size of the toner for developing latent electrostatic images is required to be smaller, while the toner particles without containing excessively fine particles are expected. Further, from the viewpoint of energy-saving, there is an increasing demand for reduction of energy required to produce the toner particles.

To meet the above-mentioned demands, many proposals are made as shown below.

(1) Japanese Laid-Open Patent Application No. 6-59507

A raw material for toner is ground using a special impact mill to control the particle size distribution of the obtained toner.

(2) Japanese Laid-Open Patent Application No. 5-313414

A raw material for toner is coarsely crushed using a mechanical mill, and the crushed particles are then subjected to fine grinding using a jet mill. In this case, the particle size of the coarse product supplied to the jet mill is controlled in advance to increase the yield.

(3) Japanese Laid-Open Patent Application No. 10-18517

One grinding system including an impact mill and the other grinding system including a mechanical mill are reversibly connected to establish a grinding system. The order of the steps consisting of the two grinding systems may be changed in accordance with the application to improve the production efficiency.

(4) Japanese Patent Publication No. 8-10350

A toner raw material is coarsely crushed, and thereafter the coarse product is subjected to secondary grinding to have a weight mean diameter of 20 to 60 $\mu$m using an impact mill.

The ground particles are finally pulverized using a jet mill. According to this method, the content of the particles with a weight mean diameter of 100 $\mu$m or more is controlled to 1 to 20% in the particles obtained by secondary grinding.

(5) Japanese Laid-Open Patent Application No. 7-92728

A magnetic toner is prepared using a binder resin, a magnetic material, and a wax. A mixture of the above-mentioned raw materials is subjected to grinding by use of a mechanical mill to satisfy the relationships of 7 $\mu m \leqq D_4 < 20$ $\mu$m and $1 < D_4/D_1 \leqq 3.5$, where $D_4$ is a weight mean diameter and $D_1$ is a length base mean diameter. After such mechanical milling, fine pulverizing is carried out by use of an impact mill.

(6) Japanese Laid-Open Patent Application No. 6-186776

A toner raw material is ground using an impact mill which is provided with a grinding section where a stator having numerous wavelike protrusions on the inner surface of the stator and a rotator having numerous wavelike protrusions on the outer surface of the rotator are disposed with a minute gap therebetween. This method aims to reduce the generation of excessively fine particles.

The conventional methods for producing the toner as mentioned above still generate a considerable amount of excessively fine particles. In particular, when fine pulverizing is carried out using a jet mill, an increase in the amount of excessively fine particles is unavoidable.

Therefore, an additional device becomes necessary to remove the excessively fine particles, and the required energy is unfavorably increased.

SUMMARY OF THE INVENTION

Accordingly, it is a first object of the present invention to provide a method of producing a toner for developing latent electrostatic images at a reduced energy, with generation of excessively fine particles being minimized.

The inventors of the present invention have intensively studied a preliminarily ground product (hereinafter referred to as a pre-ground product) in order to solve the above-mentioned problems. As a result, it has been found that a toner can be prepared at a reduced energy with minimum generation of excessively fine particles by specifying a particular particle diameter and particle size distribution in the pre-ground product. The present invention has been accomplished based on the above-mentioned finding.

Namely, the first object of the present invention can be achieved by a method of producing a toner for developing latent electrostatic images, comprising the steps of preliminarily grinding a toner composition comprising at least a binder resin and a coloring agent to prepare a preliminarily ground product, and finely pulverizing the preliminarily ground product using a pulverizer to produce toner particles, wherein the preliminarily ground product satisfies conditions (1) and (2):

$$D_v \geqq D_{10} \quad (1)$$

$$D_{50} < 3D_{10} \quad (2)$$

wherein $D_v$ is a weight mean diameter of the preliminarily ground product, $D_{10}$ is a weight mean diameter when the cumulative number of particles reaches 10% at measurement of a cumulative particle distribution, and $D_{50}$ is a weight mean diameter when the cumulative number of particles reaches 50% at measurement of the cumulative particle distribution.

DESCRIPTION OF THE PREFERRED EMBODIMENTS

A toner is usually prepared by mixing raw materials and fusing and kneading the mixture using an extruder to prepare a toner composition. Thereafter, the toner composition is cooled and pulverized, so that a desired toner is obtained. In the pulverizing process, the toner composition is first subjected to coarse crushing, then secondary grinding, and finally fine pulverizing. Fine toner particles excessively pulverized will cause deposition on the background, while large toner particles not sufficiently ground will induce defective toner image transfer. In other words, the pulverizing process is remarkably important.

The toner composition for use in the present invention comprises at least a binder resin and a coloring agent.

Any conventional resins used as the binder resins are usable.

Examples of the binder resin for use in the toner composition include polystyrene resin, styrene—acrylic acid copolymer, styrene—methacrylic acid copolymer, styrene—acrylate copolymer, styrene—methacrylate copolymer, polyester resin, epoxy resin, polyamide resin, and poly(vinyl acetal) resin.

As the coloring agent for use in the toner, carbon black, benzidine yellow pigment, acetoacetanilide-insoluble azo dye, azomethylene dye, and other conventional coloring agent can be used.

The mixing ratio of the binder resin to the coloring agent is not particularly limited, but is preferably in the range of (80:20) to (99:1), more preferably in the range of (90:10) to (95:5).

When the ratio by weight of the binder resin is less than 80%, there is a risk that the dispersion properties and the charging characteristics of the obtained toner will degrade. On the other hand, when the binder resin is contained in an amount ratio by weight of more than 99%, the color of toner becomes too thin.

The total amount of the binder resin and the coloring agent is usually in the range of 90 to 97 wt. %, preferably 92 to 96 wt. % of the entire weight of the toner composition.

The toner composition is prepared by kneading, dispersing, and fusing a mixture of the binder resin and the coloring agent using a roll mill or a kneader. In the course of the kneading step, the temperature may be controlled to the melting point of the employed binder resin.

The toner composition may further comprise a charge control agent, a releasant, and an external additive.

The toner composition thus obtained is cooled and subjected to rolling when necessary. Then, the cooled toner composition is preliminarily ground. The use of an impact mill is preferable for the preliminary grinding step.

As the impact mill for preliminary grinding, there can be employed commercially available mills, for example, "AP Pulverizer" and "Fitz Mill" (trademarks of Hosokawa Micron Corporation), and mills with a classification mechanism, for example, "ACM Pulverizer" and "Vertech Mill" (trademarks of Hosokawa Micron Corporation).

Generally, the impact mill has a grinding chamber at a minute gap between a rotor supported on a revolving shaft and a cylinder in which the rotor is fitted. The rotor is provided with numerous protrusions continuously disposed on the outer surface in a peripheral direction of the rotor. The cylinder has numerous protrusions continuously formed on the inner surface in a peripheral direction of the cylinder. An impact mill provided with a classification mechanism is preferably employed in the present invention.

The pre-ground product obtained by preliminary grinding is then finely pulverized to produce toner particles. In the present invention, the preliminary grinding step is carried out to satisfy the following conditions (1) and (2):

$$D_v \geqq D_{10} \quad (1)$$

$$D_{50} < 3D_{10} \quad (2)$$

wherein $D_v$ is the weight mean diameter of the pre-ground product, $D_{10}$ is the particle diameter when the cumulative number of particles of the pre-ground product reaches 10% at the measurement of the cumulative particle distribution by weight, and $D_{50}$ is a particle diameter when the cumulative number of particles of the pre-ground product reaches 50% at the measurement of the cumulative particle distribution by weight.

By controlling the particle diameter and the cumulative particle size distribution so as to satisfy the above-mentioned conditions (1) and (2), generation of excessively fine particles can be prevented after the pre-ground product is subjected to final fine pulverizing even by use of a jet mill. Thus, toner particles can be produced with a high yield.

In the final fine pulverizing, the kind of mill is not particular limited, but a jet mill or mechanical mill is preferably employed.

To be more specific about the above-mentioned conditions (1) and (2), $D_{10}$ (or $D_{50}$) is determined by successively accumulating the particles of the pre-ground product in an ascending order of particle diameter and finding the particle diameter when the weight of the accumulated particles reaches 10% (or 50%) of the entire weight of the pre-ground product.

The weight mean diameter is measured by Coulter counter method. The measurement is carried out using a commercially available measuring apparatus made by Coulter Electronics Ltd. A 1% aqueous solution of a first class sodium chloride is prepared as an electrolyte. A surfactant, preferably alkylbenzenesulfonate, is added in an amount of 0.5 to 5 ml as a dispersant to 10 to 15 ml of the above-mentioned electrolyte. The sample particles in an amount of 2 to 20 mg are put in the electrolyte, followed by ultrasonic dispersion for about 1 to 3 minutes.

100 to 200 ml of the electrolyte is placed in another beaker. To this electrolyte, the above prepared dispersion of the sample particles is added so as to have a predetermined concentration. The number base particle size distribution ranging from 2 to 40 $\mu$m is measured using the "Coulter Counter" with a 100-$\mu$m aperture. The weight base distribution and the number base distribution are calculated, and the weight mean diameter is obtained from the weight base distribution using the center value of each channel.

It is preferable that the weight mean diameter $D_v$ of the pre-ground product be 5 to 300 $\mu$m, and more preferably 10 to 250 $\mu$m. When the weight mean diameter $D_v$ of the pre-ground product is less than 5 $\mu$m, the amount of excessively fine particles increases to lower the yield of the toner particles. On the other hand, when the weight mean diameter $D_v$ of the pre-ground product exceeds 300 $\mu$m, the grinding power required for final pulverizing is unfavorably increased.

When $D_v$ is less than $D_{10}$, the amount of excessively fine particles increases, thereby lowering the yield of a toner as the final product. When $D_{50}$ exceeds $3D_{10}$, the grinding power required for the final fine pulverizing step unfavorably increases.

It largely depends upon the kind of resin, the composition ratios of components for a toner, kneaded condition of the resin, and the type of mill used for preliminary grinding whether the preliminary grinding step can generate a pre-ground product that can satisfy the above-mentioned conditions (1) and (2). Therefore, setting of appropriate conditions becomes of great importance.

In particular, with respect to the type of mill used for preliminary grinding, the kind of liner, the kind of rotor, the peripheral speed of the pulverizing rotor, and the temperature at the outlet are significant factors to determine the conditions (1) and (2).

For instance, when a polyester resin, a styrene—acryl copolymer resin, and carbon are mixed to prepare a toner composition, the toner composition is fused and kneaded in a roll mill, and cooled and rolled. Thereafter, the toner composition is subjected to preliminary grinding by use of the commercially available impact mill "ACM Pulverizer" (trademark), made by Hosokawa Micron Corporation. The above-mentioned pulverizer is provided with a grooved liner and a bar-shaped pulverizing rotor. In this case, the peripheral speed of the pulverizing rotor is preferably 110 to 125 m/s, and the temperature at the outlet is preferably 30 to 35° C.

After the preliminary grinding step mentioned above, the pre-ground product is finely pulverized, thereby obtaining a toner according to the present invention.

The final fine pulverizing is carried out using a jet mill or mechanical mill.

As the jet mill for final fine pulverizing, commercially available jet mills under the trademark of "Super Sonic Jet Mill Type I" and "Super Sonic Jet Mill Type IDS" provided with type DS Classifier, made by Nippon Pneumatic Mfg. Co., Ltd., and a commercially available ultra fine pulverizer "Micron Jet" made by Hosokawa Micron Corporation are preferably employed.

The above-mentioned jet mill provided with a classifier is a closed system by the combination of a pulverizer and a classifier. Coarse particles are removed from the pre-ground product by the classifier and returned to the pulverizer until a desired particle diameter required for a toner as the final product is obtained. In this jet mill, the pre-ground product is sucked using jet stream of air, accelerated and made collide with a target plate forcibly.

As the mechanical mill, there can be employed commercially available mills "Turbo Mill" (trademark), made by Turbo Kogyo Co., Ltd.; "Super Rotor" (trademark), made by Nisshin Engineering Co., Ltd.; and "Kryptron" (trademark), made by Kawasaki Heavy Industries, Ltd.

The mechanical mill is composed of a rotor rotating at a high speed and a liner with numerous grooves. A pre-ground product is pulverized at a gap between the rotor and the liner by relative rotation, and further finely pulverized by means of jet stream and cyclone of air generated behind the rotor and between the grooves of the liner.

It is preferable that the grinding power required for the final fine pulverizing be 0.3 to 1.5 kw·h/kg·h. Such a relatively low grinding power can contribute to the improvement of production efficiency.

Finally, a pulverized product can be obtained after the step of finely pulverizing the pre-ground product in the above-mentioned manner. The pulverized product thus obtained has a weight mean diameter of 5 to 20 $\mu$m, preferably 7 to 12 $\mu$m, containing excessively fine particles with a weight mean diameter of 5 $\mu$m or less in an amount of 50% or less in terms of the number of particles. When the toner for developing latent electrostatic images can be prepared in the form of the above-mentioned pulverized product, the yield of the toner product is as high as 75% or more.

Other features of this invention will become apparent in the course of the following description of exemplary embodiments, which are given for illustration of the invention and are not intended to be limiting thereof.

EXAMPLE 1

A polyester resin, a styrene—acryl copolymer, and carbon black were mixed at a ratio by weight of 75:10:15. The mixture was fused and kneaded in a roll mill at 100° C. for one hour, and then cooled and rolled to prepare a toner composition.

The toner composition thus prepared was preliminarily ground using a commercially available impact mill "AP Pulverizer" (trademark), made by Hosokawa Micron Corporation, so that a pre-ground product was obtained. The operating conditions of the above-mentioned impact mill, and the weight mean diameter $D_v$, the particle diameter represented by $D_{10}$, and the particle diameter represented by $D_{50}$ of the pre-ground product are shown in TABLE 1.

The pre-ground product was subjected to fine pulverizing by use of a commercially available jet mill "Super Sonic Jet Mill Type I" (trademark), made by Nippon Pneumatic Mfg. Co., Ltd., so that finely pulverized particles were obtained.

TABLE 1 also shows the operating conditions of the above-mentioned jet mill, the grinding power for fine pulverizing, the content (% in number) of excessively fine particles with a weight mean diameter of 5 $\mu$m or less, and the yield of toner particles after classification.

In the above, the grinding power is a value obtained by subtracting an applied power before actual pulverizing from the total power applied in the course of pulverizing.

Measurement of the particle diameter was performed by use of a commercially available measuring apparatus "Multisizer" (trademark), made by Coulter Electronics Ltd.

COMPARATIVE EXAMPLE 1

The procedure for preparation of the pre-ground product in Example 1 was repeated except that the weight mean diameter $D_v$, the particle diameter represented by $D_{10}$, and the particle diameter represented by $D_{50}$ of the pre-ground product obtained by preliminary grinding were changed as shown in TABLE 1.

The pre-ground product thus prepared was subjected to fine pulverizing using the same impact mill as in Example 1.

TABLE 1 also shows the operating conditions of the jet mill, the grinding power for fine pulverizing, the content of excessively fine particles with a weight mean diameter of 5 $\mu$m or less, and the yield of toner particles after classification.

EXAMPLE 2

A pre-ground product was prepared in the same manner as in Example 1.

The weight mean diameter $D_v$, the particle diameter represented by $D_{10}$, and the particle diameter represented by $D_{50}$ of the pre-ground product obtained by preliminary grinding are shown in TABLE 1.

The pre-ground product thus prepared was subjected to fine pulverizing using the commercially available mechanical mill "Turbo Mill" (trademark), made by Turbo Kogyo Co., Ltd., and classification, so that finely pulverized particles were obtained.

TABLE 1 also shows the operating conditions of the mechanical mill, the grinding power for fine pulverizing, the content of excessively fine particles with a weight mean diameter of 5 $\mu$m or less, and the yield of toner particles after classification.

EXAMPLE 3

The same toner composition as in Example 1 was prepared. The toner composition was preliminarily ground using a commercially available impact mill "ACM Pulverizer" (trademark), made by Hosokawa Micron Corporation, so that a pre-ground product was obtained.

The operating conditions of the above-mentioned impact mill, and the weight mean diameter $D_v$, the particle diameter represented by $D_{10}$, and the particle diameter represented by $D_{50}$ of the pre-ground product are shown in TABLE 1.

The pre-ground product was subjected to fine pulverizing by use of a commercially available mechanical mill "Turbo Mill" (trademark), made by Turbo Kogyo Co., Ltd., and classification, so that finely pulverized particles were obtained.

TABLE 1 also shows the operating conditions of the above-mentioned mechanical mill, the grinding power for fine pulverizing, the content (% in number) of excessively fine particles with a weight mean diameter of 5 μm or less, and the yield of toner particles after classification.

COMPARATIVE EXAMPLE 2

The procedure for preparation of the pre-ground product in Example 3 was repeated except that the weight mean diameter $D_v$, the particle diameter represented by $D_{10}$, and the particle diameter represented by $D_{50}$ of the pre-ground product obtained by preliminary grinding were changed as shown in TABLE 1.

The pre-ground product was subjected to fine pulverizing by use of a commercially available mechanical mill "Turbo Mill" (trademark), made by Turbo Kogyo Co., Ltd., and classification, so that finely pulverized particles were obtained.

TABLE 1 also shows the operating conditions of the mechanical mill, the grinding power for fine pulverizing, the content of excessively fine particles with a weight mean diameter of 5 μm or less, and the yield of toner particles after classification.

EXAMPLE 4

The procedure for preparation of the pre-ground product in Example 3 was repeated except that the operating conditions of the impact mill "ACM Pulverizer" were changed as shown in TABLE 1.

The weight mean diameter $D_v$, the particle diameter represented by $D_{10}$, and the particle diameter represented by $D_{50}$ of the pre-ground product obtained by preliminary grinding are shown in TABLE 1.

The pre-ground product was subjected to fine pulverizing by use of a commercially available mechanical mill "Turbo Mill" (trademark), made by Turbo Kogyo Co., Ltd., and classification, so that finely pulverized particles were obtained.

TABLE 1 also shows the operating conditions of the mechanical mill, the grinding power for fine pulverizing, the content of excessively fine particles with a weight mean diameter of 5 μm or less, and the yield of toner particles after classification.

EXAMPLE 5

The procedure for preparation of the pre-ground product in Example 3 was repeated except that the operating conditions of the impact mill "ACM Pulverizer" were changed as shown in TABLE 1.

The weight mean diameter $D_v$, the particle diameter represented by $D_{10}$, and the particle diameter represented by $D_{50}$ of the pre-ground product obtained by preliminary grinding are shown in TABLE 1.

The pre-ground product was subjected to fine pulverizing by use of a commercially available mechanical mill "Turbo Mill" (trademark), made by Turbo Kogyo Co., Ltd., and classification, so that finely pulverized particles were obtained.

TABLE 1 also shows the operating conditions of the mechanical mill, the grinding power for fine pulverizing, the content of excessively fine particles with a weight mean diameter of 5 μm or less, and the yield of toner particles after classification.

TABLE 1

| | Preliminary Grinding | | | | | Fine Pulverizing | | | |
|---|---|---|---|---|---|---|---|---|---|
| | Impact mill | Peripheral speed of rotor (m/s) | $D_V$ (μm) | $D_{10}$ (μm) | $D_{50}$ (μm) | Pulverizer | Grinding power (kw · h/kg · h) | Content of fine particles (%) | After Classification Yield (%) |
| Ex. 1 | AP Pulverizer | 110 | 220 | 140 | 220 | Super Sonic Jet Mill | 1.1 | 50 | 79 |
| Comp. Ex. 1 | AP Pulverizer | 30 | 350 | 100 | 320 | Super Sonic Jet Mill | 1.9 | 50 | 79 |
| Ex. 2 | AP Pulverizer | 110 | 220 | 140 | 220 | Turbo Mill | 1.1 | 40 | 88 |
| Ex. 3 | ACM Pulverizer | 110 | 55 | 14 | 40 | Turbo Mill | 0.45 | 35 | 88 |
| Comp. Ex. 2 | ACM Pulverizer | 90 | 75 | 12 | 50 | Turbo Mill | 0.68 | 25 | 75 |
| Ex. 4 | ACM Pulverizer | 125 | 40 | 12 | 20 | Turbo Mill | 0.4 | 20 | 93 |
| Ex. 5 | ACM Pulverizer | 120 | 38 | 11 | 17 | Turbo Mill | 0.4 | 20 | 94 |

As previously explained, the present invention can provide a method of producing a toner for developing latent electrostatic images at a reduced grinding power, with a minimum amount of excessively fine particles. Such a toner preparation method can significantly contribute to design and manufacture of an electrophotographic copying machine, printer, and facsimile machine where latent electrostatic images formed on a latent-image-bearing member are developed with a developer to produce visible recording images.

Japanese Patent Application No. 2000-012698 filed Jan. 21, 2000 is hereby incorporated by reference.

What is claimed is:

1. A method of producing a toner for developing latent electrostatic images, comprising:

preliminarily grinding a toner composition comprising at least a binder resin and a coloring agent in an impact mill having a rotor speed of 110 to 125 m/sec to prepare a preliminarily ground product, and finely pulverizing said preliminarily ground product using a pulverizer to apply a grinding power of 0.3 to 1.5 kW·h/kg·h to produce toner particles;

wherein said preliminarily ground product satisfies conditions (1) and (2):

$$D_v \geqq D_{10} \quad (1)$$

$$D_{50} < 3D_{10} \quad (2)$$

wherein $D_v$ is a weight mean diameter of said preliminarily ground product;

$D_{10}$ is a weight mean diameter when the cumulative number of particles reaches 10% at measurement of a cumulative particle distribution; and $D_{50}$ is a weight mean diameter when the cumulative number of particles reaches 50% at measurement of said cumulative particle distribution.

2. The method as claimed in claim 1, wherein said preliminary griding step is carried out using an impact mill with a classification mechanism.

3. A preliminarily ground product to be supplied to a final fine pulverizing step in preparation of a toner for developing latent electrostatic images;

wherein said preliminary ground product is obtained by grinding a toner composition comprising at least a binder and a coloring agent in an impact mill having a rotor speed of 110 to 125 m/sec;

wherein said preliminarily ground product satisfies conditions (1) and (2):

$$D_v \geqq D_{10} \quad (1)$$

$$D_{50} < 3D_{10} \quad (2)$$

wherein $D_v$ is a weight mean diameter of said preliminarily ground product;

$D_{10}$ is a weight mean diameter when the cumulative number of particles reaches 10% at measurement of a cumulative particle distribution; and $D_{50}$ is a weight mean diameter when the cumulative number of particles reaches 50% at measurement of said cumulative particle distribution.

4. A pulverized product obtained by fine pulverizing the preliminary ground product of claim 3 by applying a grinding power of0.3 to 1.5 kw·h/kg·h;

wherein said pulverized product has a weight mean diameter of 5 to 20 $\mu$m, and contains fine particles with a weight mean diameter 5 $\mu$m or less in a number of 50% or less of the entire particle number of said pulverized product.

5. A method of using the pulverized product of claim 4 as a toner for developing latent electrostatic images, comprising: contacting a substrate with the pulverized product of claim 4.

6. The method according to claim 1, wherein said binder resin is selected from the group consisting of a polystyrene resin, a styrene-acrylic acid copolymer, a styrene-methacrylic acid copolymer, a styrene acrylate copolymer, a styrene-methacrylate copolymer, a polyester resin, an epoxy resin, a polyamide resin, a poly(vinyl acetal) resin and a mixture thereof.

7. The method according to claim 1, wherein said coloring agent is selected from the group consisting of carbon black, benzidine yellow pigment, acetoacetanilide-insoluble azo dye, azomethylene dye and a mixture thereof.

8. The method according to claim 1, wherein a mixing ratio of the binder resin to the coloring agent is in the range of from 80:20 to 99:1.

9. The method according to claim 1, wherein a mixing ratio of the binder resin to the coloring agent is in the range of from 90:10 to 95:5.

10. The method according to claim 1, wherein a total amount of the binder resin and the coloring agent is in the range of 90–97 wt.% based on a total weight of said toner composition.

11. The method according to claim 1, wherein said toner composition further comprises a charge control agent, a releasant, and an external additive.

12. The method according to claim 1, wherein said toner composition is prepared by kneading, dispersing and fusing a mixture of a binder resin and a coloring agent using a roll mill or a kneader.

13. The method according to claim 12, wherein said toner composition is cooled, and optionally rolled.

14. The method according to claim 1, wherein a temperature at an outlet of said impact mill is 30 to 35° C.

15. The method according to claim 1, wherein said finely pulverizing is carried out using a jet mill or mechanical mill.

16. The method according to claim 1, wherein a yield of said toner is 75% or more.

17. The method according to claim 1, wherein said binder and said coloring agent are not admixed with a liquid.

18. The method according to claim 1, wherein said fine pulverizing is carried out with a mechanical mill.

19. The preliminary ground product according to claim 3, wherein said weight mean diameter $D_v$ is 5 to 300 $\mu$m.

* * * * *

UNITED STATES PATENT AND TRADEMARK OFFICE

CERTIFICATE OF CORRECTION

PATENT NO. : 6,368,765 B2
DATED : April 9, 2002
INVENTOR(S) : Mitsuyoshi Izu et al.

It is certified that error appears in the above-identified patent and that said Letters Patent is hereby corrected as shown below:

Column 4,
Line 19, “particular limited” should read -- particularly limited --.

Column 5,
Line 35, “collide with a target” should read -- to collide with a target --.

Column 9,
Line 50, “of0.3” should read -- of 0.3 --.

Signed and Sealed this

Twenty-third Day of July, 2002

*Attest:*

*Attesting Officer*

JAMES E. ROGAN
*Director of the United States Patent and Trademark Office*